US005946771A

United States Patent [19]

Bosyj et al.

[11] Patent Number: 5,946,771

[45] Date of Patent: Sep. 7, 1999

[54] VACUUM CLEANER AIR EXHAUST ARRANGEMENT

[75] Inventors: Nick M. Bosyj; Arne J. Diehl, both of North Canton, Ohio

[73] Assignee: The Hoover Company, North Canton, Ohio

[21] Appl. No.: 08/780,859

[22] Filed: Jan. 9, 1997

[51] Int. Cl.[6] ..... A47L 9/12

[52] U.S. Cl. ..... 15/347; 15/351

[58] Field of Search ..... 15/347, 350, 351, 15/352, 327.7

[56] References Cited

U.S. PATENT DOCUMENTS

| | | | |
|---|---|---|---|
| 2,174,443 | 9/1939 | Lofgren | 15/327.7 X |
| 2,979,755 | 4/1961 | McCaskill | 15/352 X |
| 3,203,157 | 8/1965 | Watlington . | |
| 3,218,783 | 11/1965 | Ripple . | |
| 3,614,860 | 10/1971 | Grellsson | 15/347 X |
| 3,866,263 | 2/1975 | Crouser et al. | 15/327.7 X |
| 4,202,070 | 5/1980 | Harfst | 15/352 X |
| 4,209,875 | 7/1980 | Pugh et al. | 15/347 X |
| 4,517,705 | 5/1985 | Hug | 15/351 |
| 4,724,574 | 2/1988 | Bowerman et al. . | |
| 5,685,894 | 11/1997 | Bowerman et al. | 15/350 X |

FOREIGN PATENT DOCUMENTS

| | | |
|---|---|---|
| 39592/78 | 3/1980 | Australia . |
| 931308 | 8/1973 | Canada . |
| 1440924 | 4/1966 | France . |
| 9400712 | 1/1994 | Rep. of Korea . |
| 989204 | 4/1965 | United Kingdom . |
| 1154604 | 6/1969 | United Kingdom . |

OTHER PUBLICATIONS

Photo—Fantom® Fury Cleaner, Model F10051.—Received Mar. 7, 1996.

*Primary Examiner*—Chris K. Moore

*Attorney, Agent, or Firm*—A. Burgess Lowe; Thomas R. Kingsbury

[57] ABSTRACT

A hard bag cleaner is provided where cleaner air is exhausted through a lower positioned motor-fan system disposed in the hard bag portion of its cleaner. Air then moves upwardly along the side of the hard bag portion of the cleaner to be exhausted horizontally outwardly therefrom. A series of vertically extending guiding vents formed by vertically extending louvers baffle exhaust air flow and also serve as an inner support for a filter mounted outwardly against these louvers.

22 Claims, 7 Drawing Sheets

VACUUM CLEANER AIR EXHAUST ARRANGEMENT

BACKGROUND OF THE INVENTION

1. Field of the Invention

This invention relates to vacuum cleaners and, more specifically, to an exhaust arrangement for a vacuum cleaner.

2. Summary of the Prior Art

Cleaner air exhaust arrangements have been of necessity provided in vacuum cleaners since their inception. These exhaust arrangements have taken many forms and, from early on, have utilized baffling and louvering to guide and attenuate exhaust air induced noise. Heretofore, however, it is not known to advantageously provide exhaust louvering to not only guide and attenuate air exhaust noise but also to provide a convenient support for a final filter arrangement for the cleaner.

Accordingly, it is an object of this invention to provide an improved cleaner air exhaust arrangement.

It is an additional object-of this invention to provide this improved cleaner air exhaust arrangement in a cleaner having a rigid bag housing.

It is a still further object of the invention to provide this improved cleaner air exhaust arrangement in a hard bag portion of an upright vacuum cleaner.

It is an additional object of the invention to include guiding louvers in the exhaust arrangement of a cleaner.

It is a further object of the invention to provide exhaust louvers that guide and baffle the air and, additionally, provide support for an outwardly arrayed filter arrangement.

It is a still further object of the invention to provide a final filter mount where its presence may be visually ascertained.

SUMMARY OF THE INVENTION

A hard bag cleaner having a motor-fan system disposed in its bottom portion houses a dirt collecting bag within it. The bag receives dirty air from a nozzle or foot attached to the same bottom portion of the hard bag.

Air flows outwardly from the bag, as the vacuum imposed on this bag by the motor-fan system moves this air downwardly in the hard bag towards the suction side of the motor-fan system. Air discharges from the motor-fan system axially sidewardly from it where the air turns 90° to be exhausted upwardly along a closed side of the hard bag and through vertically extending louvers. These louvers aid in even distribution of the clean air, serve as a baffle arrangement for it and provide, by their outer vertically extending face terminations, a support mounting for a final filter including at least a filter pad. A filter holding frame and an outwardly disposed exhaust grill are also mounted with this filter pad.

BRIEF DESCRIPTION OF THE DRAWINGS

Reference now may be had to the accompanying Drawings for a better understanding of the invention, both as to its organization and function, with the illustrations showing both preferred and alternate embodiments, but being only exemplary, and in which.

DETAILED DESCRIPTION OF THE INVENTION

Figure 1:
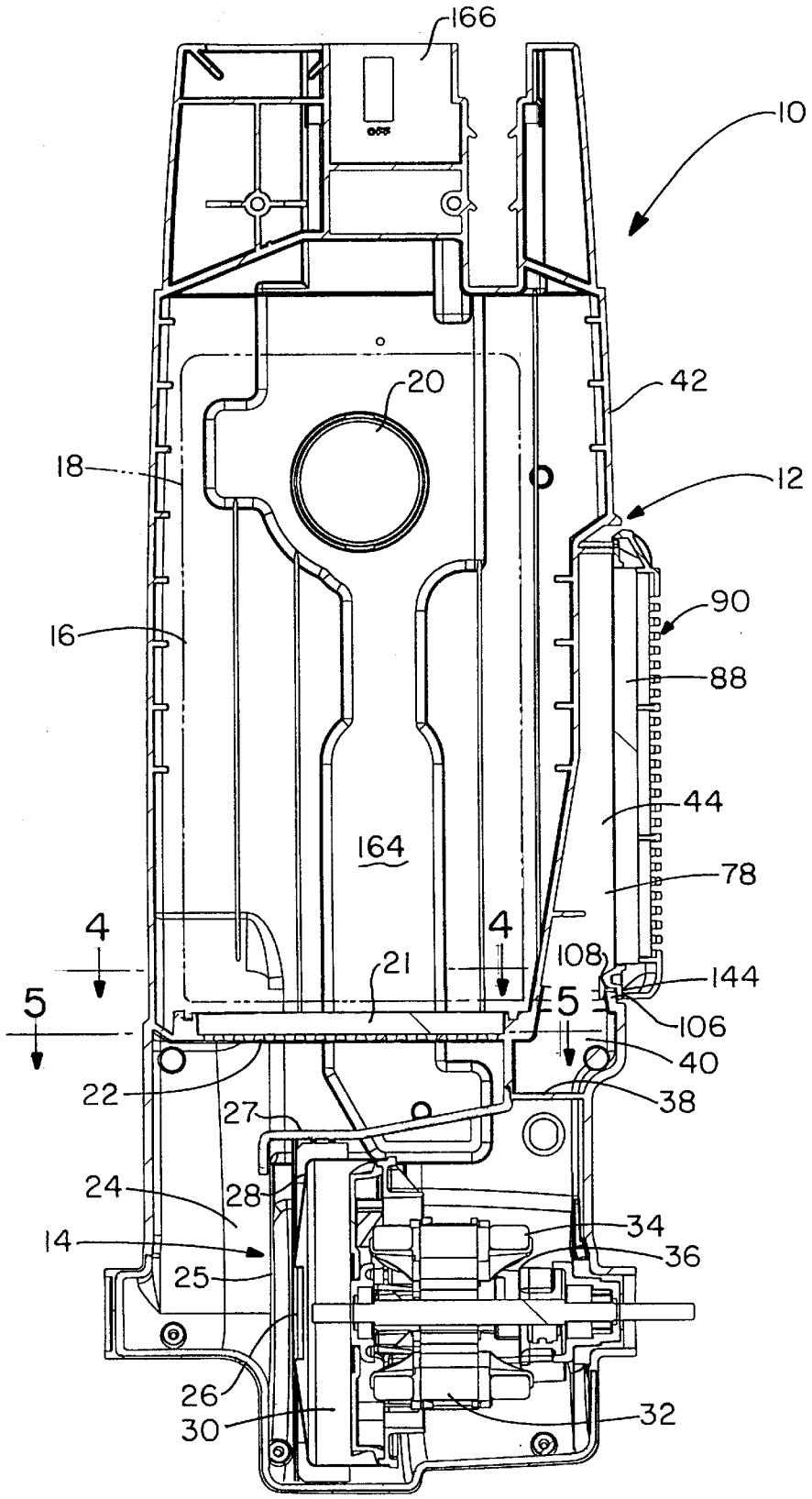
FIG. 1 is a generalized cross sectional elevational view of a hard bag portion of a cleaner with the bag door removed which incorporates the invention.

There is shown partially in FIG. 1, an upright cleaner 10 with the bag door removed but having a hard bag upper portion 12 which houses a motor-fan system 14 at its lower end and forms upwardly of the motor-fan system 14 a large open volume constituting a bag cavity 16. The bag cavity 16 lodges a dirt collecting bag 18 (only partially shown) which confluently communicates with the nozzle or foot (not shown) of the upright cleaner 10 through a hose (not shown) extending between the nozzle or foot and a bag mounting suction tube portion 20 disposed extending within and integral with the hard bag portion 12. The mounting arrangement between the bag 18 and bag mounting suction tube portion 20 is conventional and, for example, may include a bag mounting plate (not shown) that is received frictionally over the tube portion 20 to maintain the bag 18 within the bag cavity 16 and confluent with the foot or nozzle of the upright cleaner 10.

To permit clean air to flow in a relative unobstructed manner from the dirt bag 18 to the motor-fan system 14, an open ribbed air passing frame 22 is disposed across lower reaches of the hard bag upper portion 12. Air flows through an upwardly mounted secondary filter 21, conveniently formed as a pad, and then the air passing frame 22 and then downwardly along the lower left side (FIG. 1) of the hard bag portion 12 through a vertically extending passageway 24 where it turns horizontally inwardly through a transverse opening 25 formed in the hard bag portion 12 by a motor-fan integral cover section 27 and confluent with an opening 26 formed in a motor-fan housing portion 28 of motor-fan system 14 to be moved through a fan 30 and a motor 32 of the fan-motor system 14.

Figure 6:
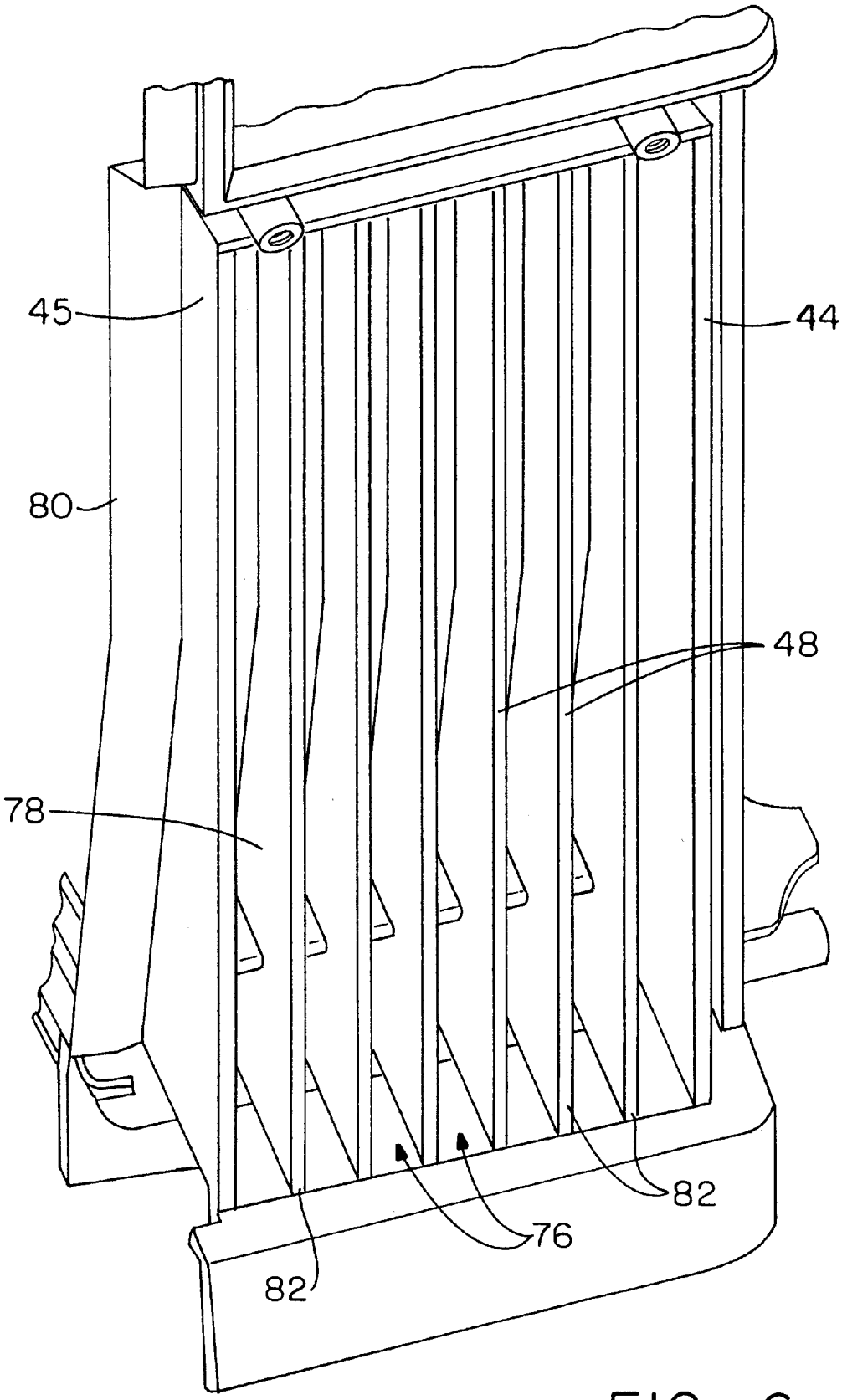
FIG. 6 is a fragmentary perspective view of that duct portion including the guiding louvers

Air is discharged outwardly and upwardly through a winding 34 of motor 32 as is conventional in bypass motors to then pass upwardly through a discharge opening 36 of motor-fan housing portion 28. This discharge opening is confluent with a discharge opening 38 formed in motor-fan integral cover section 27 and a vertically extending segmented discharge duct 40 of the same dimensions as the discharge opening 38 and disposed outwardly of the boundaries of the hard bag 12 and formed partially by a outer vertical side wall 42 of the hard bag 12, partially by duct rear and front walls 44, 45 (FIGS. 2) formed integrally with hard bag portion 12. It is also formed partially by a series of vertically extending vanes or louvers 48, 48, 48, (6 in number) (FIG. 6) integral with and extending outwardly from the vertical side wall 42 of hard bag portion 12 and the segmented duct 40 is completed by an outwardly disposed filter arrangement 46 which will be described in greater detail later.

Figure 2:
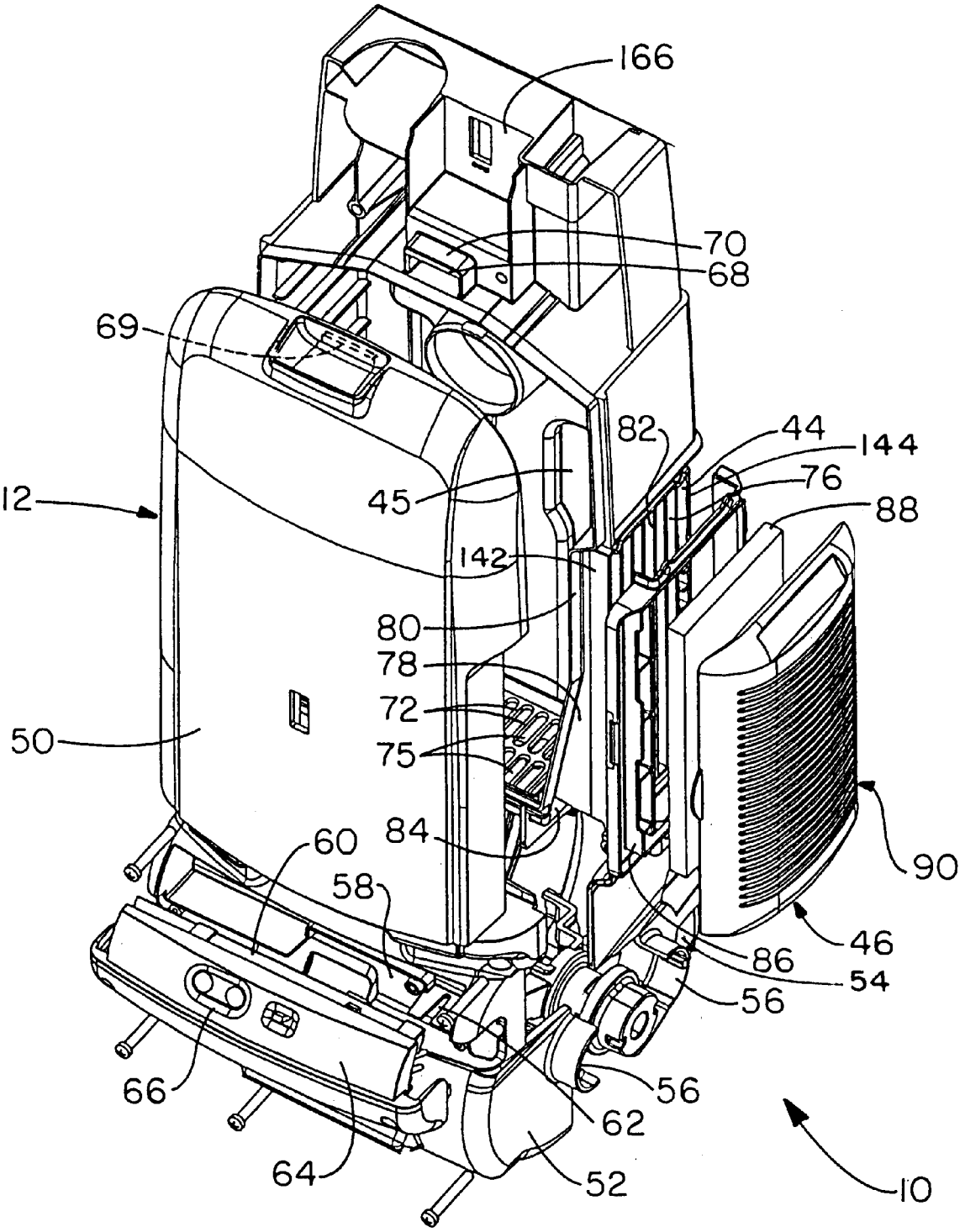
FIG. 2 is an exploded perspective view of most of the constituent elements forming the view of FIG. 1.
Figure 3:
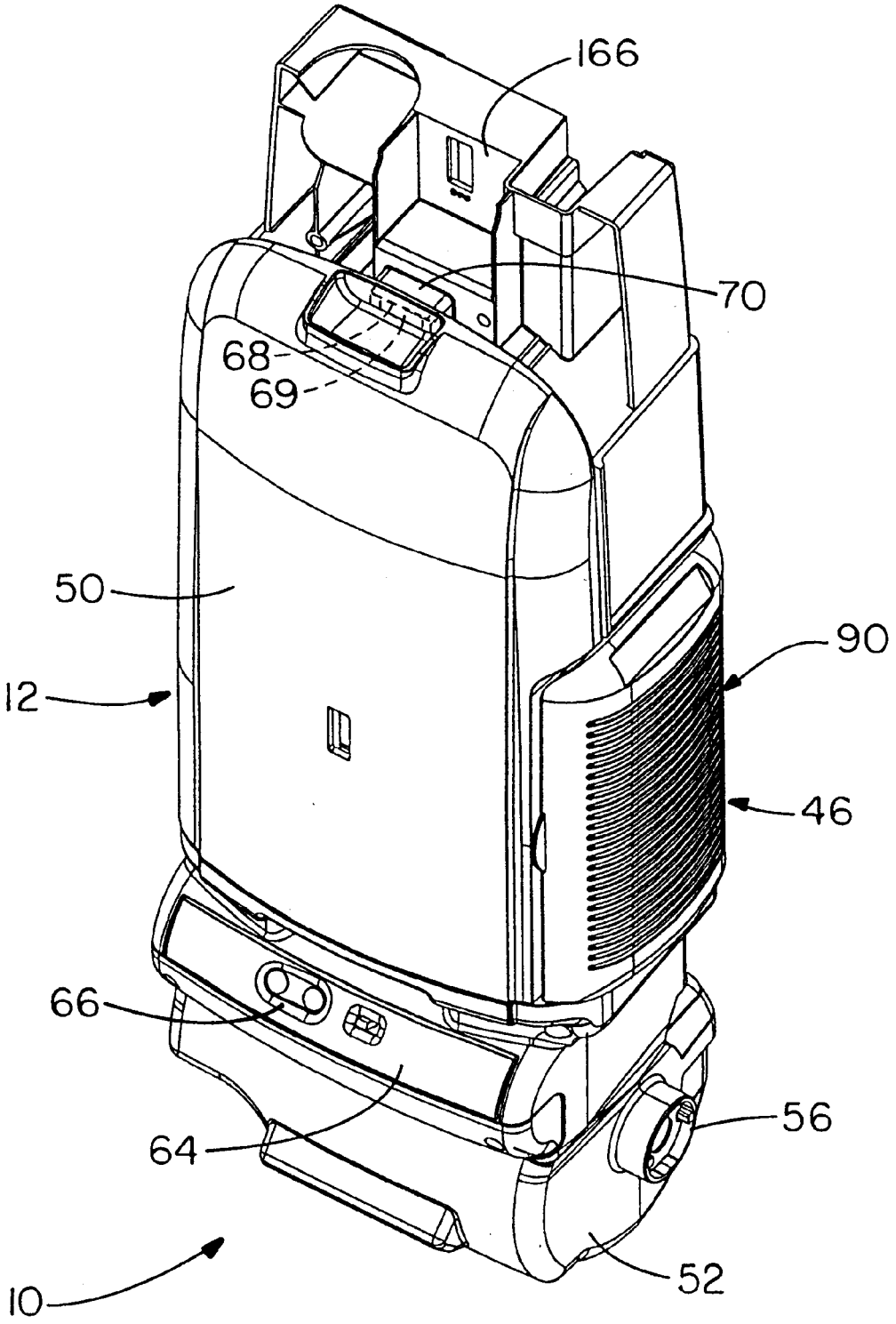
FIG. 3 is a perspective view of the assembled parts of the view of FIG. 2 and showing the outline of the cleaner hard bag.
Figure 4:
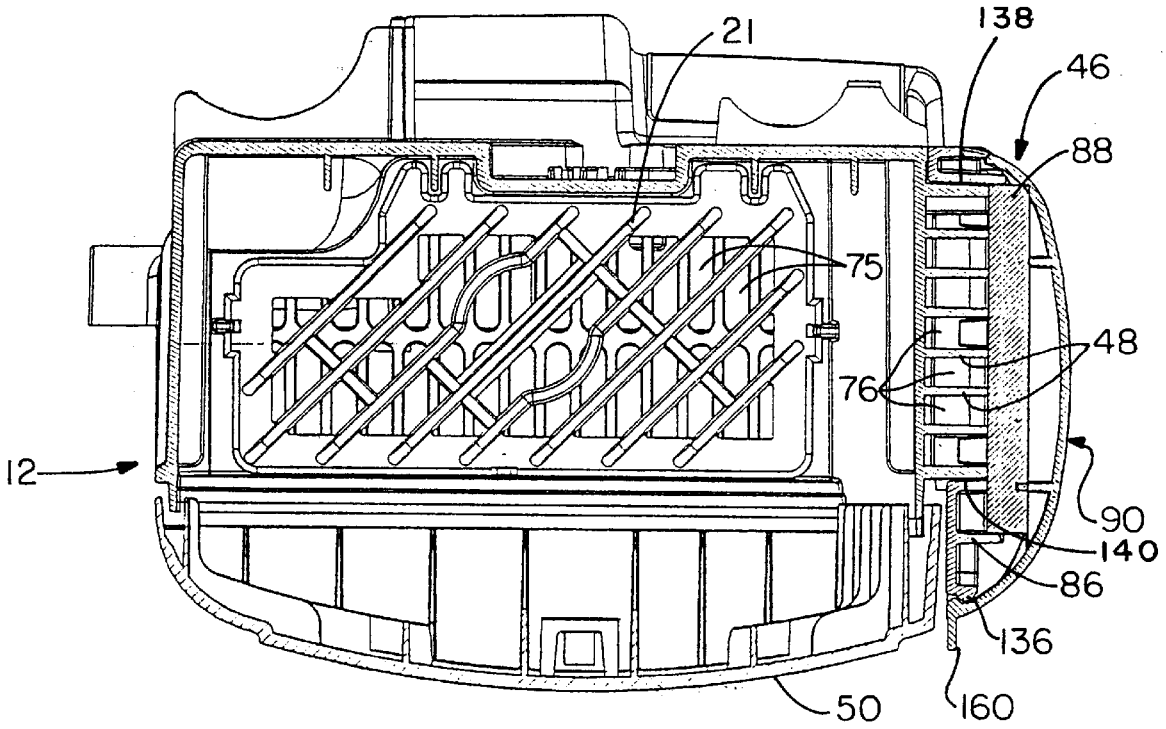
FIG. 4 is a horizontal cross sectional view of the cleaner hard bag taken generally on line 4—4 of FIG. 1 and showing a portion of the clean air passageway.
Figure 5:
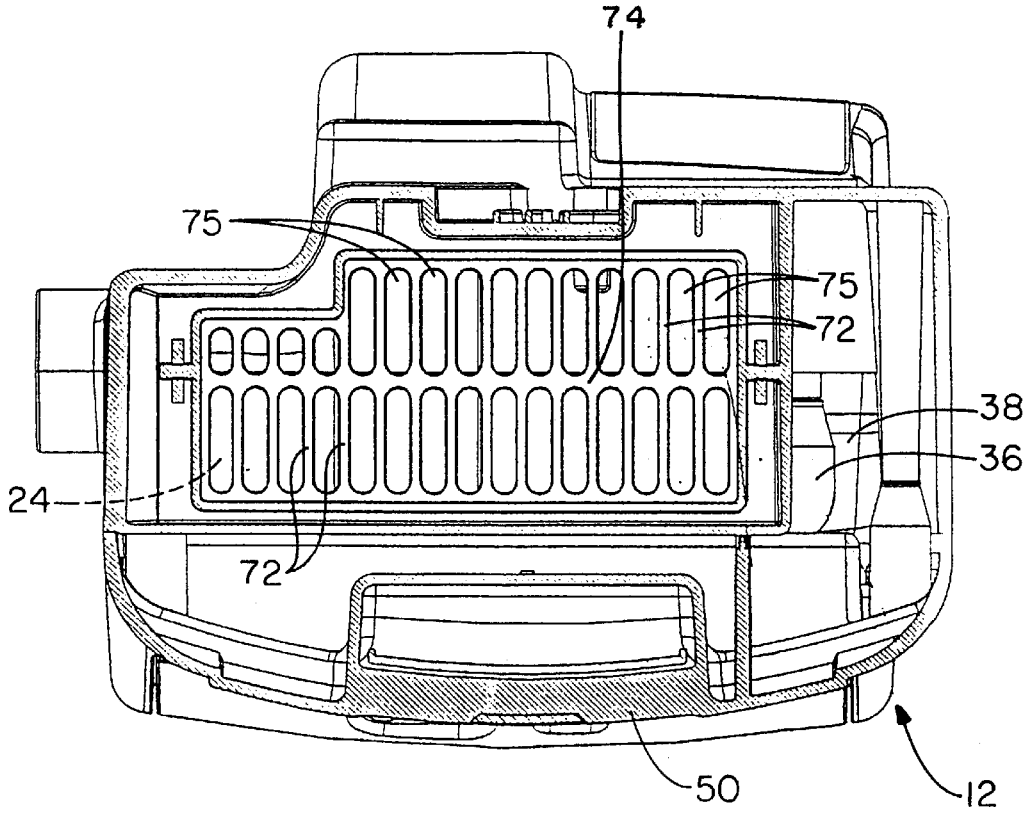
FIG. 5 is also a horizontal cross sectional view of the cleaner hard bag taken on line 5—5 of FIG. 1 and showing a portion of the clean air passageway.

Turning specifically now to both FIGS. 1 and 2, it can be seen that upright cleaner 10 includes a bag door 50 which lug engages (not shown) at its bottom to a front housing section 52 of hard bag portion 12 of cleaner 10 which, with a lower portion outer rear housing section 54 of hard bag portion 12 envelopes motor-fan housing portion 28. This section is generally semi-cylindrical in shape and is a separate piece and forms, with an outer rear housing section 54 integral with hard portion 12 and also of generally semi-cylindrical shape the lower contours of the outer surface of hard bag cleaner 10. These housing sections cooperate, as is usual, to form a pair of foot or nozzle trunnion pieces 56, 56.

The front housing section 52, on its forward face area, includes a light bulb indent 58 for the mounting of a light bulb (not shown) and a generally open area 62 surrounding indent 58 and extending sidewardly thereof for mounting a hood piece 64. Hood piece 64 streamlines the lower front of the hard bag portion 12 and provides for, for example, for the mounting of dirt detecting indicating array 66. It also obscures a circuit board assembly 60 which may include electrical components of a dirt detecting circuit (not shown) which operates the dirt detecting array 66.

The bag door 50 is latched to the hard bag housing portion 12 conveniently, at its top, by a flexing latch bar 69 (shown fragmentarily), mounted integrally on bag door SO, and having a rear upwardly opening latching hook (not shown) that engages behind a thickened latch plate 68 on a fixed latch piece 70 which is integral with hard bag housing portion 12.

Turning specifically now to FIGS. 2–5, the clean air exhaust system is more clearly seen. The open ribbed passing frame 22 which passes air downwardly and outwardly of the bag cavity 16 includes spaced ribs 72, 72, 72, etc. that extend rearwardly and forwardly within this cavity and which are reinforced by a medial, transversely extend rib 74. These ribs are all integral with bag housing portion 12 and, in total, form streamlined exit slots 75, 75, 75, etc. Below this frame, the clean air conventionally passes downwardly through passageway 24 (shown in plan in FIG. 5 and also in elevation in FIG. 1). After its passage through the motor-fan system 14, the discharge air passes through discharge opening 36 of motor-fan housing portion 28 (shown in elevation in FIG. 1) and then through air exit 38 in hard bag motor-fan cover 27 (shown in plan in FIG. 4 and elevation in FIG. 1) at which time it enters segmented discharge duct 40.

The segmented discharge duct 40 including a discharge opening 76, generally at the vertical and longitudinal extent of the vertically extending vanes or louvers 48, 48, 48, 48, 48 and 48. The louvers 48 each have an enlarged truncated triangular portion 78 that merges into a narrower, generally rectangular upper portion 80 as do the front and rear duct walls 45, 44. This serves to smoothly reduce the discharge cross sectional flow area to thereby slightly increase the clear air carry velocity within segmented duct 40. This tends to distribute discharge air flow over the total vertical extent of the discharge opening 76.

Each of the outer terminations 82 of the vanes 48 is conveniently flat and straight to provide a series of flat faces that provide a planar mounting surface. This surface is enhanced by the fact that the truncated triangular portion 78 of each of the vanes 48, angles only inwardly to closely follow the form of a lower angled vertical side wall portion 84 of side wall 42 of hard bag portion 12.

The vanes 48, are provided equally spaced within the segmented discharge duct 40 and are, as set out previously, six in number so as to function adequately but still be moldable.

Figure 7:
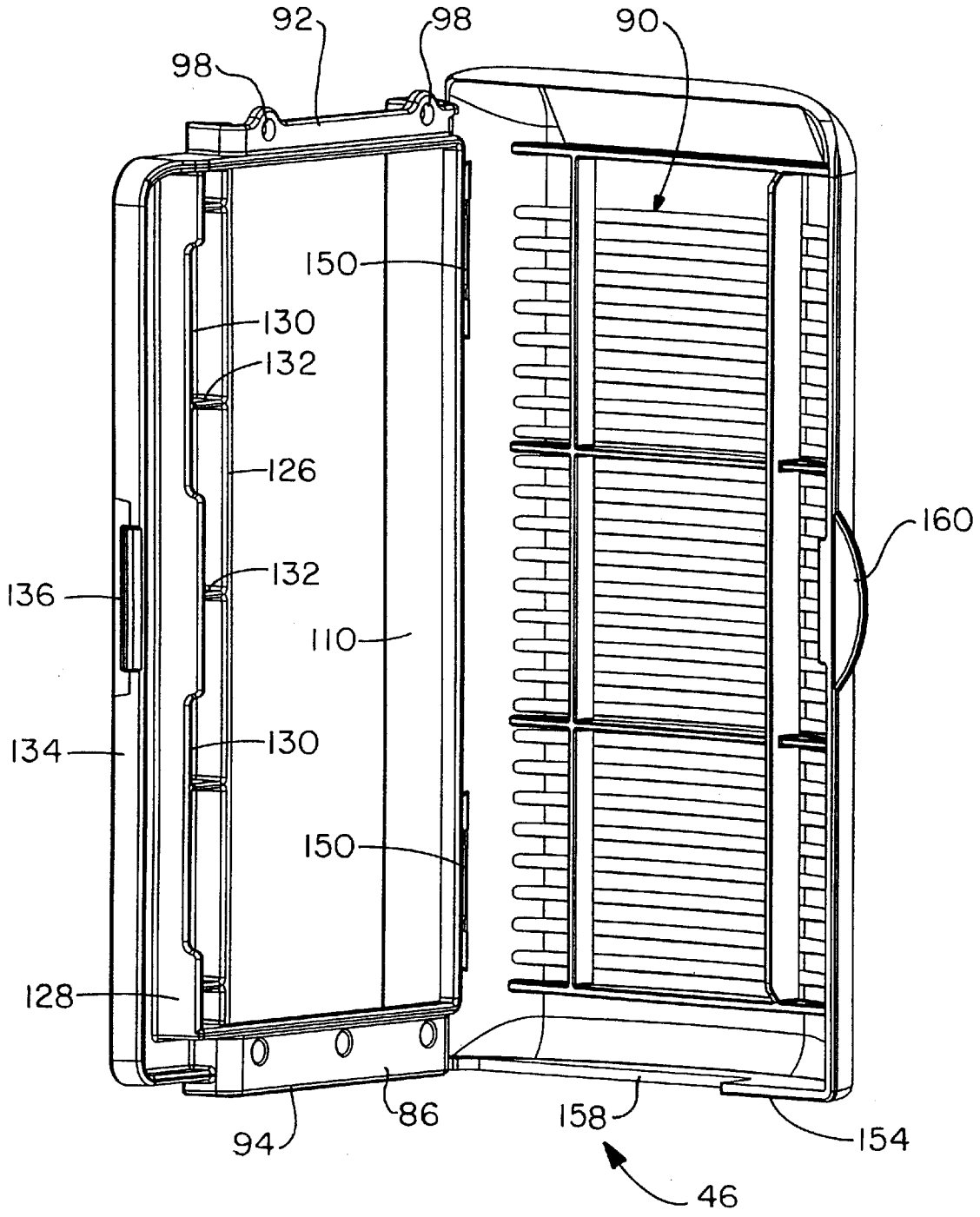
FIG. 7 is a perspective view of the filter frame and hinged cover grill utilized in this invention.
Figure 9:
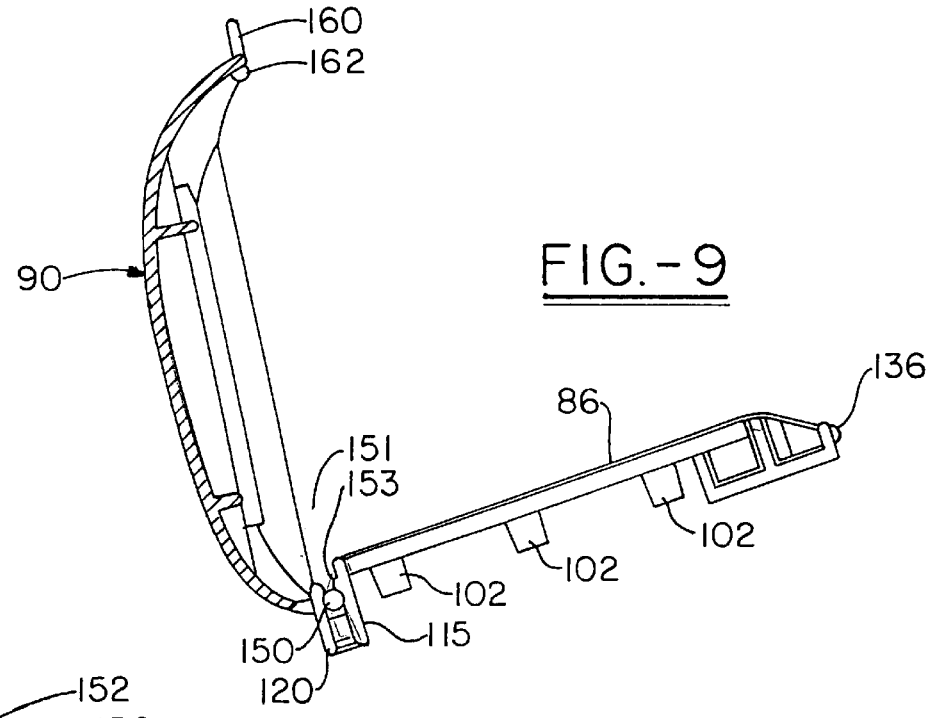
FIG. 9 is a cross sectional view of the filter frame and hinged cover grill of FIG. 6 taken through the upper hinge.
Figure 8:
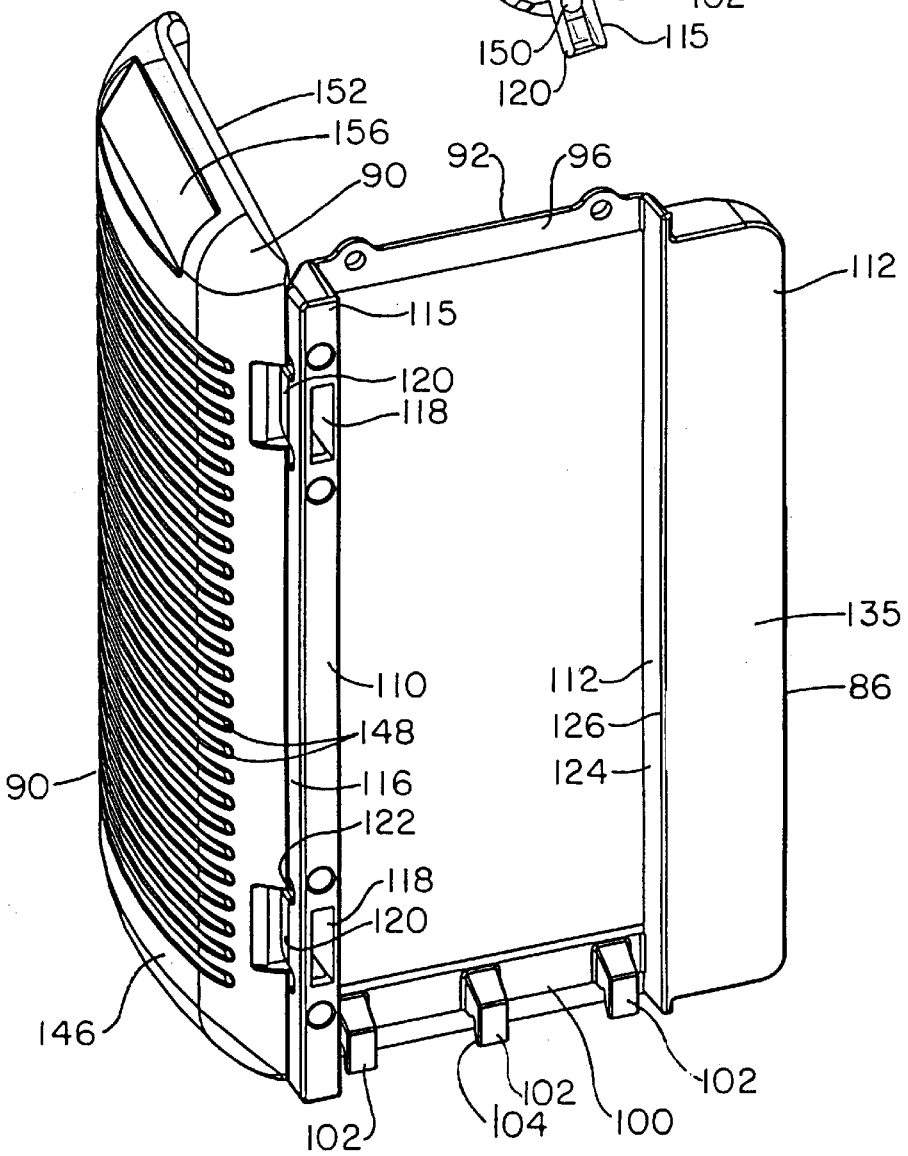
FIG. 8 is the obverse perspective view of that shown in FIG. 6.

The filter arrangement 46 (generally shown best in FIGS. 7–9) is the final filter for the cleaner 10 and is attached to the sidewall 42 of the hard bag portion 12 cleaner 10. It includes a holding frame 86 which mounts the filter arrangement 46 to the cleaner 10, a filter pad 88 disposed within the holding frame 86 and abutting on its inner side the louvers 48, 48, 48, 48, 48 and 48 and an outer grill 90 hingedly attached to the holding frame 86 to move between an open and closed position over the filter pad 88.

The holding frame 86 is formed much like an open rectangle and includes upper and lower frame members 92 and 94, respectively with the upper frame member 92 providing an uninterrupted flat inner surface 96 which forms the upper side of the sealing surface of the holding frame 86. It includes a pair of screw receiving apertures 98, 98 through which screws (not shown) mountingly maintain upper portions of the holding frame 86 against the side 42 of hard bag cleaner 10. Lower frame member 94 also includes a flat planar expanse 100 utilized for the lower sealing of the holding frame 86, but this flat surface is interrupted by a series of three equally spaced downwardly extending hooks 102, 102, 102 whose hook portions 104 engage over a lip 106 formed on a termination of a solid lower surface on segmented duct 40 by the lower termination of a rectangular side opening 108 in segmented duct 40 that extends the full height of the louvers 48, 48 and 48, 48, 48, 48 and forms the discharge opening 76. The upstanding remaining portions of the hooks 102, 102, 102 telescopically interleave between these same louvers.

The holding frame 86 also includes a pair of vertically extending side structures 110, 112. The rearwardmost side structure 110 (FIG. 2) includes an outwardly facing smooth sealing face 114 formed on parallel flange 115 and a rearwardly disposed, spaced parallel flange 116. The space between the parallel flanges 115, 116 includes a connecting web 117 having a pair of hinge forming pintle openings 118, 118. Outwardly of each, is disposed an outwardly jutting hinge pintle 120, which extends outwardly from and as a continuation of flange 116. The pintle openings 118, 118 enable the successful molding of the hinge pintles 120, 120. The connecting web 117 also includes a pair of spaced outwardly extending short hinge locating lugs 122, 122, adjacent each hinge pintle, which help locate the outer grill 90 in its hingedly mounted position along the mounting frame 86.

The forwardmost side structure 112 of holding frame 86 includes a flat planar inner sealing surface 124 formed on a vertically extending rib 126. Spaced from this rib is a second vertically extending rib 128 (FIG. 7) which is deeper than rib 126 and stepped in elevational extent to provide a pair of discontinuities 130, 130, the purpose of which will soon become apparent. Horizontal, short reinforcing ribs 132, 132, 132, 132 and 132 extend integrally between the two ribs 126, 128.

The holding frame 86 is completed by an outer, right angled flange section 134 which is shorter in depth than the rib 128 provides a pleasing appearance to forward portions of the mounted holding frame and a flat face 135 that extends from the user side of this flange inwardly integrally to the vertically extending rib 126. The flange section includes a forwardly extending, integral latch plate 136 which forms half the operative latching mechanism for the outer grill 90.

The filter pad 88 lies within the holding frame 86 between its upper and lower frame members 92, 94 and its vertically extending side structure 110 and vertically extending rib 128, overlying the louvers 48, 48, 48, 48, 48 and 48 and the vertically extending rib 126 whose outer face termination is coplanar with the outer face termination of the louvers when the holding frame 86 is assembled to the hard bag 12 of hard bag cleaner 10.

The effective cross sectional area of filtering is then between the upper and lower frame members 92, 94, the vertically extending side structure 110 and the vertically extending rib 126. But the portion of filter pad 88, between the vertically extending rib 126 and the stepped vertically extending rib 128, is, importantly, then clearly visible through the discontinuities 130, 130 to provide a visual indication of the presence of this filter in an operative position within this cleaning system.

The holding frame 86 is finally sealed against the side 42 of hard bag cleaner around its aforesaid sealing peripheries by mounting it abuttingly against sealing portions 138, 140, 142 and 144.

The grill 90 is somewhat curvilinear in plan to provide a curvilinear surface 146 and a streamlined appearance to this easily visible part. It includes a series of horizontally extending, vertically equally spaced, exhaust slots 148 which extend to follow smoothly along the curvilinear surface 146. As is conventional, sufficient slots are provided to limit back pressure to the system.

The grill 90 is formed as a swinging door by including along its hinged side, a pair of vertically spaced, vertically extending generally cylindrically shaped hinge pintles or pins 150, 150. These pins are received in a snapping manner in the hinge openings 151, 151 of holding frame 86 so that they cammingly lodge behind the somewhat hooked surface of pintles 120, 120 and enlargement 153, 153 on the inner face of parallel flange 115.

The grill 90 includes integral upper and lower ends 152, 154, with the upper end including an angled relief 156 to permit easy manual manipulation of the grill 90 for opening or closing thereof. This upper end is also shaped somewhat curvilinearly in its vertical extension for streamlining purposes. The lower end is disposed, essentially, as a right angled extension of the curvilinear surface 146. It includes a cutout 158 which permits the grill 90 to clear the outwardly situated frame member 94 when the grill 90 is swung "to". The upper end 152 of the grill 90 terminates sufficiently far upwardly in a vertical direction to conveniently nest over upper frame member 92 of holding frame 86.

The grill 90 is completed by a sidewardly and outwardly jutting integral grasping tab 160 integral with an inwardly jutting latch plate 162. This latch plate is deformingly received over latch plate 136 of holding frame 86 when the grill 90 is in closed, operating condition.

The filter pad 88 has been shown somewhat diagrammatically since, ideally, it may be multilayered with the filtering layers disposed from a coarser to a finer material as one goes from initial duct discharge to atmosphere. This structural arrangement of filtering material is well known in the art so the same has not been illustrated in the various views of the Drawings of the cleaner 10.

The general description of the cleaner 10 should note that an inwardly extending three sided, irregularly shaped housing portion 164 is formed integrally in the rear side of the hard bag portion 12. It extends for most of the vertical height of the hard bag portion and furnishes a volume for the electrical wiring (not shown) for the cleaner motor 32 and also for the dirt detecting array 66. A handle mounting pocket 166 is also included for the upward mounting of a handle (not shown) on the upper end of hard bag portion 12.

It should be clear from the foregoing description of the invention that all the objects set out for it have been achieved. It should also be apparent that many modifications could obviously be made to the disclosed structure which would still fall within its spirit and purview. For example, the grill could be made as a snapfit, or the louvers could be varied in number or shape.

What is claimed is:

1. An exhaust system for a vacuum cleaner including:

a motor-fan assembly providing a flow of air to said exhaust system;

an exhaust duct confluently connected to the discharge side of said motor-fan assembly; and a series of spaced, parallel exhaust louvers, each of said louvers extending along substantially an entire length of a longitudinal wall of said exhaust duct.

2. The exhaust system for a vacuum cleaner as set out in claim 1 wherein:

a) said exhaust duct includes a discharge port contiguous to said exhaust louvers.

3. The exhaust system for a vacuum cleaner as set out in claim 2 wherein:

a) said exhaust louvers extend in said exhaust duct along and confront said discharge port.

4. The exhaust system for a vacuum cleaner as set out in claim 3 wherein:

a) a filter is disposed generally outwardly of said exhaust duct.

5. The exhaust system for a vacuum cleaner as set out in claim 4 wherein:

a) said filter is formed as a filter pad; and b) said pad filter rests on outer face terminations of said louvers.

6. The exhaust system for a vacuum cleaner as set out in claim 5 wherein:

a) said filter pad is held to rest against said outer face terminations of said louvers by a holding frame; and b) said holding frame is mounted to said vacuum cleaner.

7. The exhaust system for a vacuum cleaner as set out in claim 6 wherein:

a) an outer exit grill is attached to said holding frame to cover and protect said filter pad.

8. The exhaust system for a vacuum cleaner as set out in claim 7 wherein:

a) said outer exit grill is openable.

9. The exhaust system for a vacuum cleaner as set out in claim 8 wherein:

a) said exhaust grill is hingedly attached to said holding frame.

10. The exhaust system for a vacuum cleaner as set out in claim 1 wherein:

a) said exhaust duct and spaced exhaust louvers extend vertically; and b) said flow of air exhausts outwardly of said exhaust duct in a transverse manner between said spaced exhaust louvers.

11. The exhaust system for a vacuum cleaner as set out in claim 10 wherein:

a) said exhaust louvers are deeper in dimension at their entrance ends and narrower in dimension at their discharge ends.

12. The exhaust system for a vacuum cleaner as set out in claim 1 wherein:

a) said exhaust louvers are at least partly triangular in shape in elevation.

13. The exhaust system of a vacuum cleaner as set out in claim 1 wherein:

a) a discharge port is provided in said exhaust duct;

b) said spaced exhaust louvers extend axially along said duct to transversely face said discharge port;

c) whereby said louvers tend to smooth air flow, dampen air flow noise and distribute said baffled air flow along said louvered discharge port.

14. The exhaust system for a vacuum cleaner as set out in claim 13 wherein:

a) said exhaust duct extends vertically along the side of said vacuum cleaner.

15. An exhaust system for a vacuum cleaner including:

an exhaust duct extending along the side of said vacuum cleaner;

a series of spaced, parallel exhaust louvers, each of said louvers extending substantially an entire length of said exhaust duct;

said exhaust duct having a discharge port formed therein;

a filter pad disposed outwardly of said discharge port;

a mounting frame holding said filter pad attached to said vacuum cleaner;

said mounting frame including at least one discontinuity; and whereby the presence or absence of said filter pad may be visually ascertained.

16. The exhaust system for a vacuum cleaner as set out in claim 15 wherein:

a) said mounting frame has said discontinuity formed on an outer frame member; and b) an inner frame is disposed closely to and parallel to the outer frame member to serve to clamp said filter pad between it and the border of said exhaust duct.

17. An exhaust system for a vacuum cleaner including:

a motor-fan assembly providing a flow of air to said exhaust system;

an exhaust duct confluently connected to the discharge side of said motor-fan assembly;

a series of spaced exhaust louvers, of each of said louvers extending along substantially the entire length of said exhaust duct; and a filter disposed generally outwardly of said exhaust duct.

18. An exhaust system for a vacuum cleaner including:

a motor-fan assembly providing a flow of air to said exhaust system;

an exhaust duct confluently connected to the discharge side of said motor-fan assembly;

a series of spaced exhaust louvers extending within said exhaust duct in a longitudinal direction along said exhaust duct;

a filter pad disposed outwardly of a discharge port for said exhaust duct;

a mounting frame attached to said cleaner maintaining said filter pad over said discharge port; and a grill hingedly mounted to said mounting frame to cover and protect said filter pad.

19. The exhaust system for a vacuum cleaner as set out in claim 18 wherein:

said mounting frame includes at least one discontinuity; and whereby the presence or absence of said filter pad can be visually determined.

20. An exhaust system for a vacuum cleaner including:

an exhaust duct extending along the side of said vacuum cleaner;

a series of spaced, parallel and continuous exhaust louvers extending within said exhaust duct;

said exhaust duct having a discharge port formed therein;

a filter pad disposed outwardly of said discharge port;

a mounting frame holding said filter pad attached to said vacuum cleaner;

said mounting frame including at least one discontinuity;

whereby the presence or absence of said filter pad may be visually ascertained;

said mounting frame has said discontinuity formed on an outer frame member; and and inner frame is disposed closely to and parallel to the outer frame member to serve to clamp said filter pad between it and the border of said exhaust duct.

21. An exhaust system for a vacuum cleaner including:

a motor-fan assembly providing a flow of air to said exhaust system;

an exhaust duct confluent connected to the discharge side of motor-fan assembly, said exhaust duct having a longitudinal wall;

a series of spaced exhaust louvers extending longitudinally within said exhaust duct; and an exhaust grill positioned over said exhaust duct, said exhaust grill being formed with a series of exhaust slots which extend transversely across said exhaust duct generally perpendicular to the longitudinally extending exhaust louvers.

22. The exhaust system for a vacuum cleaner as set out in claim 21 wherein:

said exhaust duct and exhaust louvers extend vertically; and said exhaust slots extend horizontally when the vacuum cleaner is in an upright position.

* * * * *